US008820973B2

(12) United States Patent
Quadri et al.

(10) Patent No.: US 8,820,973 B2
(45) Date of Patent: Sep. 2, 2014

(54) STAGE LIGHTING FIXTURE

(75) Inventors: Pasquale Quadri, Torre de' Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 266 days.

(21) Appl. No.: 13/331,954

(22) Filed: Dec. 20, 2011

(65) Prior Publication Data

US 2012/0155090 A1 Jun. 21, 2012

(30) Foreign Application Priority Data

Dec. 21, 2010 (IT) ..... MI2010A2335

(51) Int. Cl.
*F21V 29/00* (2006.01)
*F21V 15/06* (2006.01)
*F21W 131/406* (2006.01)

(52) U.S. Cl.
CPC ..... *F21V 15/06* (2013.01); *F21W 2131/406* (2013.01)
USPC ..... 362/294; 362/293

(58) Field of Classification Search
USPC ..... 362/261–265, 293–294
See application file for complete search history.

(56) References Cited

U.S. PATENT DOCUMENTS

| | | | |
|---|---|---|---|
| 4,890,208 | A | 12/1989 | Izenour |
| 5,371,655 | A | 12/1994 | Murdock et al. |
| 5,402,326 | A | 3/1995 | Belliveau |
| 5,515,254 | A | 5/1996 | Smith et al. |
| 2007/0217204 | A1 | 9/2007 | Hough et al. |

FOREIGN PATENT DOCUMENTS

| | | |
|---|---|---|
| EP | 0511829 | 11/1992 |
| EP | 0678701 | 10/1995 |

*Primary Examiner* — Jason Moon Han
(74) *Attorney, Agent, or Firm* — Leason Ellis LLP

(57) ABSTRACT

A stage lighting fixture having :

a light source for emitting a light beam along an optical axis;

a reflector coupled to the light source;

at least one dichroic filter for selectively intercepting the light beam; and at least one heat-shield assembly located between the light source and the dichroic filter, and having a heat-shield filter, in turn having a first portion with first beam filtering properties, and a second portion with second beam filtering properties.

15 Claims, 4 Drawing Sheets

STAGE LIGHTING FIXTURE

The present invention relates to a stage lighting fixture.

BACKGROUND OF THE INVENTION

Stage lighting fixtures are known comprising a light source for emitting a light beam; a reflector coupled to the light source; and at least one dichroic filter for selectively intercepting and colouring the light beam.

Stage lighting fixtures of this sortall have one drawback: frequent overheating of the light source—normally a discharge lamp—which results in impaired reliability of the fixture and obvious discomfort to the user.

SUMMARY OF THE INVENTION

It is an object of the present invention to provide a stage lighting fixture designed to eliminate the above drawbacks of the known art, and which, in particular, is reliable and ensures an adequate working life of the light source.

According to the present invention, there is provided a stage lighting fixture as claimed in claim 1.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
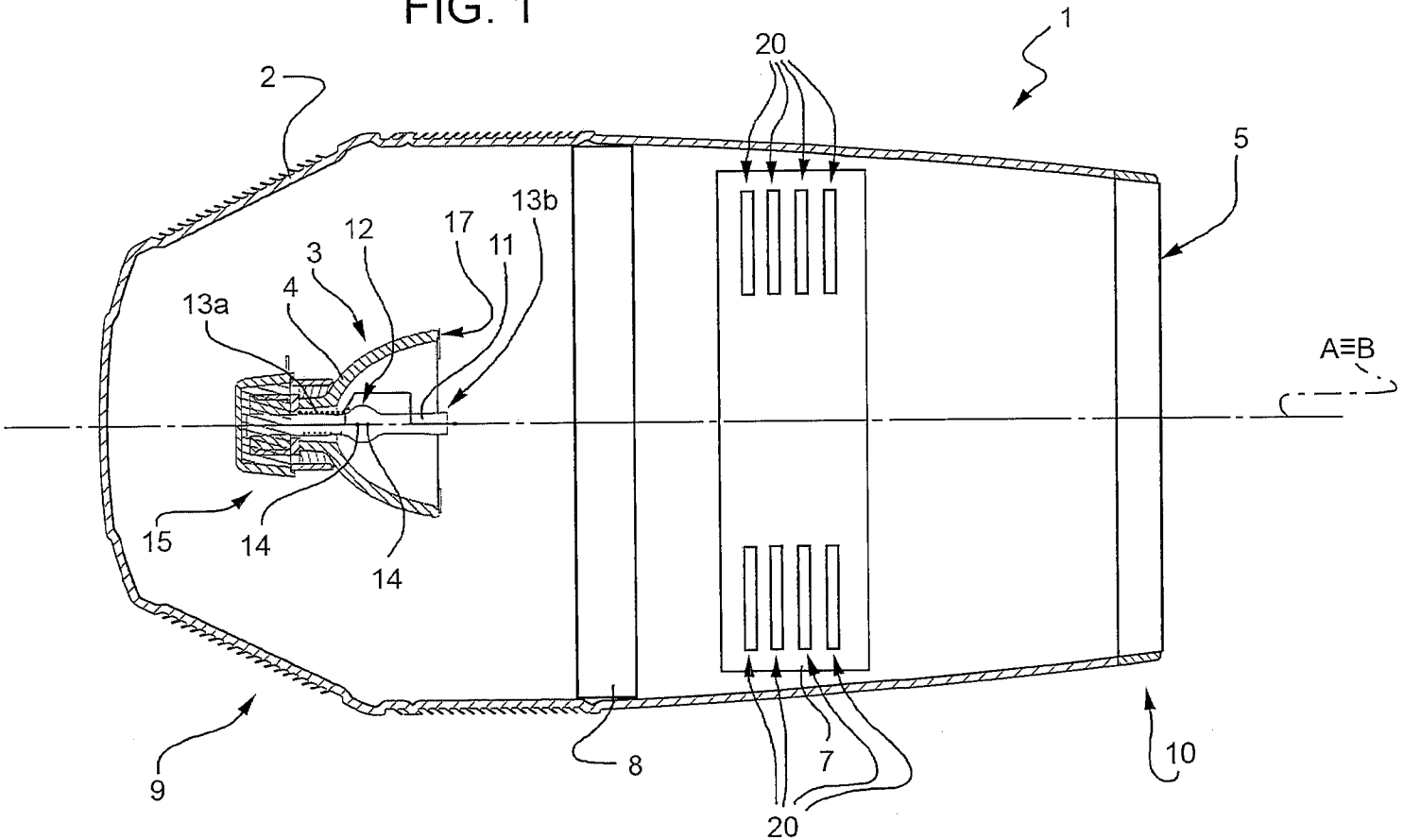
FIG. 1 shows a schematic of a stage lighting fixture in accordance with the present invention.

Number 1 in FIG. 1 indicates a stage lighting fixture comprising a casing 2; a light source 3; a reflector 4; an objective lens 5; a dichroic colour assembly 7 (shown schematically in FIG. 1); and a heat-shield assembly 8 (shown schematically in FIG. 1).

Casing 2 extends along a longitudinal axis A, has a closed end 9 and an open end 10 opposite closed end 9 along axis A, and is preferably supported on mounting means (not shown in the drawings for the sake of simplicity). More specifically, the mounting means and casing 2 are designed to permit rotation of casing 2 about two perpendicular, so-called PAN and TILT axes.

Light source 3 is housed inside closed end 9 of casing 2, is fitted to casing 2, and is designed to emit a light beam substantially along an optical axis B.

In the non-limiting example described and shown, optical axis B coincides with longitudinal axis A of casing 2.

Light source 3 is preferably a discharge lamp comprising a normally glass or quartz bulb 11 containing halides.

Bulb 11 comprises a substantially spherical centre portion 12; and two substantially tubular lateral portions 13*a*, 13*b*, preferably, though not necessarily, with a rectangular or circular cross section. Lateral portions 13*a*, 13*b* are substantially identical; the cross section size of lateral portions 13*a*, 13*b* substantially depends on the power of the lamp; and centre portion 12 contains two electrodes 14 connected to a power circuit 15 (shown partly in the drawings).

The light beam is emitted substantially at centre portion 12 of bulb 11; whereas lateral portions 13*a*, 13*b* emit no light and are located in the shadow cone of light source 3.

In the non-limiting embodiment described and shown, light source 3 is a metal-iodide lamp.

Reflector 4 is preferably elliptical, is coupled to light source 3, and has an outer edge 17.

Objective lens 5 is located at open end 10 of casing 2, and may be a Fresnel lens (in the case of a 'wash' lighting fixture).

Dichroic colour assembly 7 comprises a number of pairs of dichroic filters 20 (shown schematically in FIG. 1) for selectively intercepting and colouring the light beam.

Dichroic filters 20 are arranged successively along optical axis B of the light beam, and are designed to transmit light of given wavelengths, and to reflect light of other wavelengths.

The colour of the beam from the lighting fixture therefore depends on the wavelengths of the light not reflected by dichroic filter 20 intercepting the beam.

More specifically, each dichroic filter 20 comprises a glass substrate coated with layers of dielectric material, and differs from the adjacent dichroic filter 20 as to the number and thickness of the layers of dielectric material deposited on the glass substrate.

In the non-limiting example described and shown, dichroic colour assembly 7 comprises four pairs of dichroic filters 20 (cyan, magenta, yellow and orange).

Figure 2:
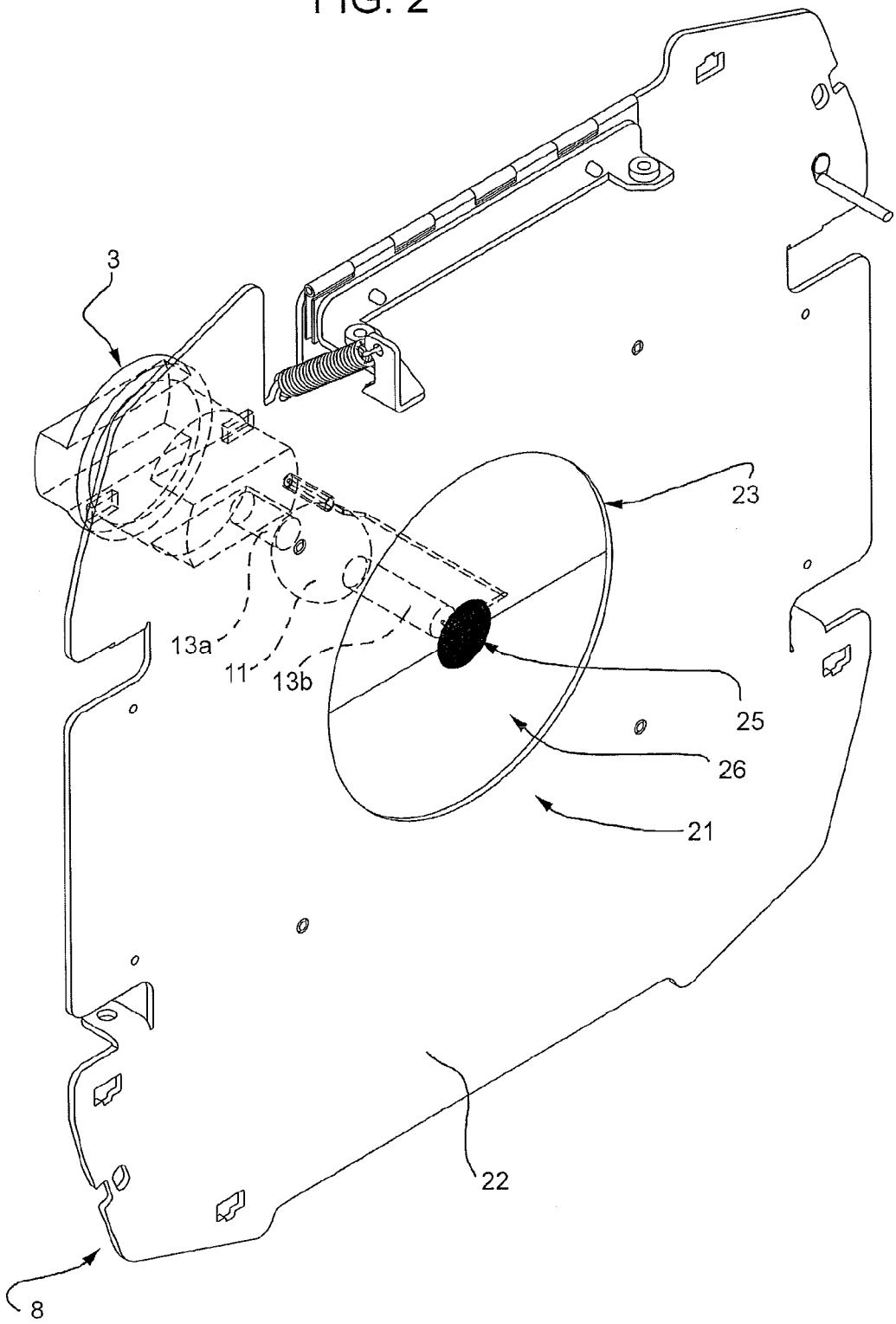
FIG. 2 shows a view in perspective of a first detail of the FIG. 1 lighting fixture.

As shown in FIG. 2, heat-shield assembly 8 comprises a heat-shield filter 21; and a frame 22 having a central hole 23 to let the light beam through, and designed to support heat-shield filter 21 over central hole 23.

Heat-shield assembly 8 is substantially designed to form a heat barrier between the area housing light source 3, and the area housing dichroic colour assembly 7.

Heat-shield filter 21 comprises a first portion 25 with first beam filtering properties; and a second portion 26 with second beam filtering properties.

First and second portions 25 and 26 are contiguous. More specifically, first portion 25 is circular and located at the centre of heat-shield filter 21; and second portion 26 is annular and surrounds first portion 25.

Substantially, second portion 26 is designed to filter invisible hot light (light which heats the body on which it impinges), to prevent it from striking the dichroic filters; and first portion 25 is designed to filter the visible hot light reflected by the dichroic filters.

First portion 25 is preferably sized on the basis of the cross section size of lateral portion 13*b* of bulb 11 next to heat-shield assembly 8. More specifically, first portion 25 must be sized to protect lateral portion 13*b* from the visible hot light reflected by the dichroic filters, and, in the non-limiting example described and shown, is roughly 20 mm in diameter.

First portion 25 preferably has a transmittance of roughly 0.1-0.5% for wavelengths in the roughly 400-650 nm range, and a transmittance of over 20% for wavelengths in the roughly 650-1000 nm range.

Here and hereinafter, 'transmittance' is intended to mean the fraction (percentage) of incident light that passes through a test piece (the filter) at a given wavelength.

Second portion 26 has a beam transmittance of over 90% for wavelengths in the roughly 425-680 nm range, and a beam transmittance of less than 3% for wavelengths in the roughly 800-1150 nm range.

Figure 3:
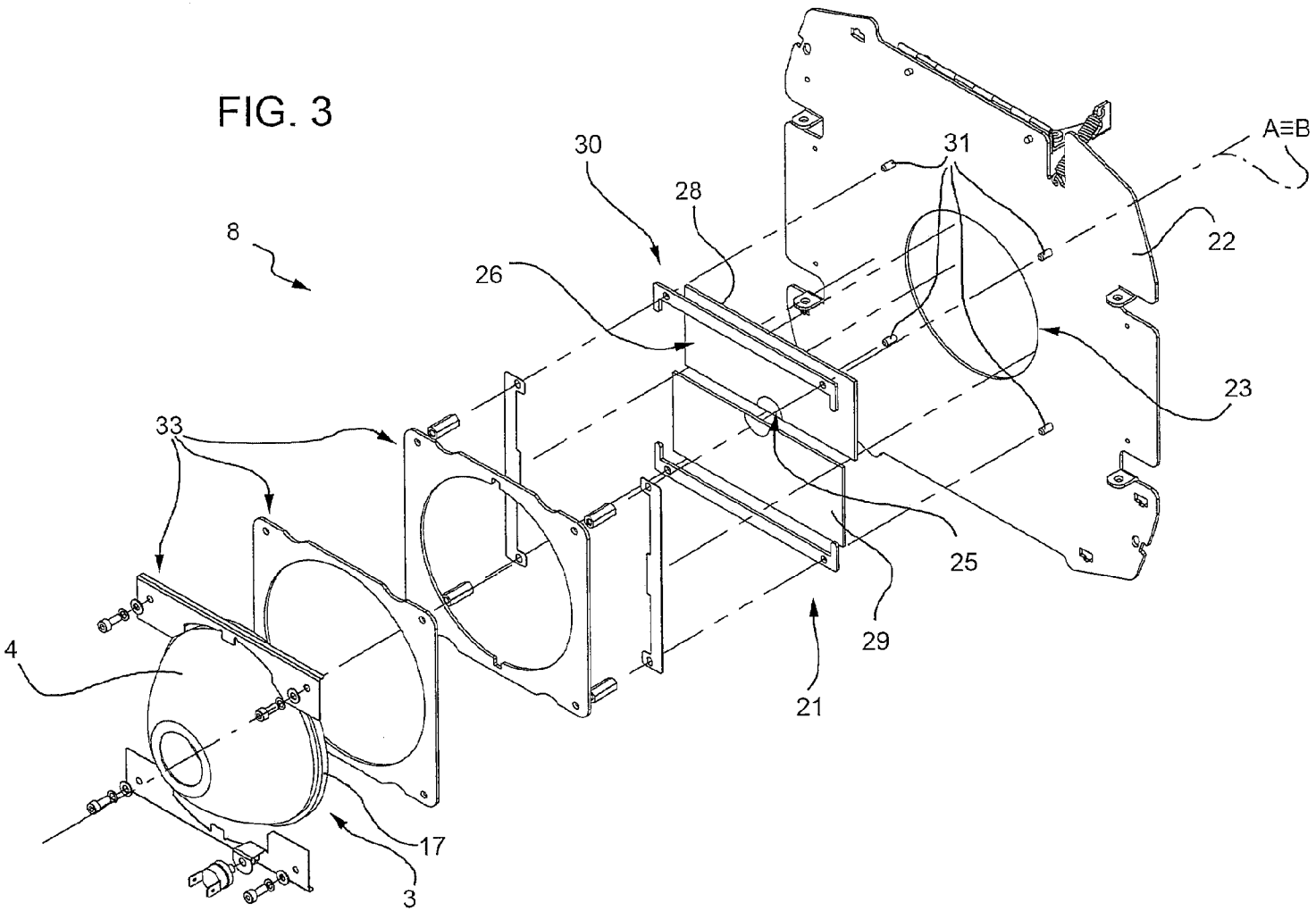
FIG. 3 shows an exploded view in perspective of the first detail in FIG. 2.

As shown in FIG. 3, heat-shield filter 21 is defined by a first member 28 and a second member 29 coupled to each other.

First and second members 28, 29 comprise half of first and second portions 25, 26 respectively.

First and second members 28, 29 are preferably rectangular, and fitted to frame 22 by a metal border 30, and by fasteners 31 for fixing metal border 30 to frame 22.

First and second members 28, 29 are respectively made of material with the same filtering characteristics as second portion 26, and are coated, over a portion corresponding to half of first portion 25, with a layer of dielectric material designed to produce the filtering characteristics of first portion 25 described above.

Frame 22 preferably also supports reflector 4, the outer edge 17 of which is fitted to frame 22 by coupling means 33.

Figure 4:
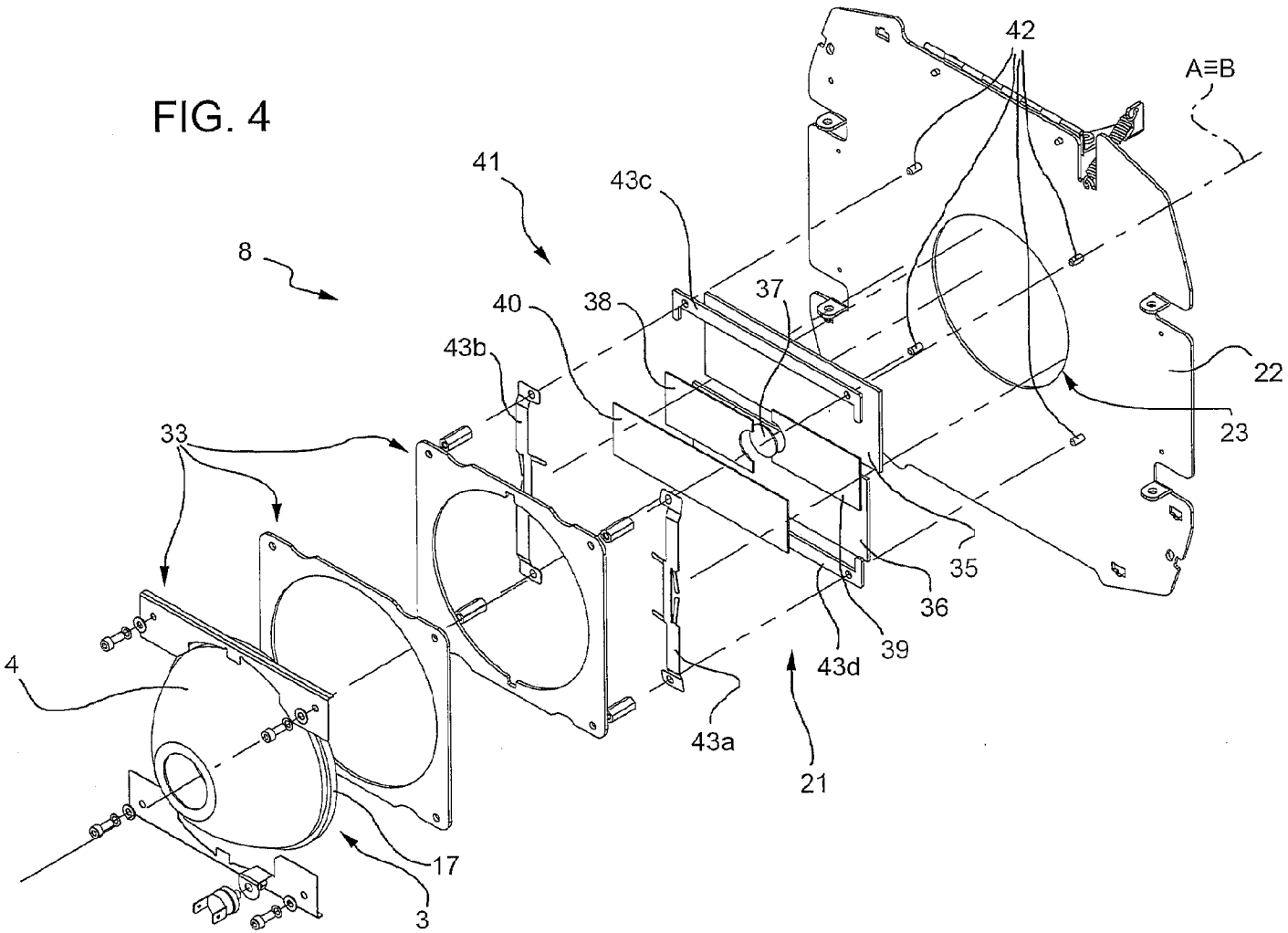
FIG. 4 shows an exploded view in perspective of a second detail of a second embodiment of the lighting fixture according to the present invention.

FIG. 4 shows a second embodiment of heat-shield filter 21, which is defined by a first member 35 and second member 36 coupled to define second portion 26; a third member 37 defining first portion 25; and a fourth member 38, fifth member 39, and sixth member 40 for supporting third member 37.

First and second members 35 and 36 are rectangular and fitted to frame 22 by a metal border 41 and fasteners 42 for fixing metal border 41 to frame 22. More specifically, border 41 is defined by four plates 43*a*, 43*b*, 43*c*, 43*d* appropriately shaped and coupled to one another.

First and second members 35 and 36 are made of material with the same filtering characteristics as second portion 26.

Third member 37 is made of material with the same filtering characteristics as first portion 25, and has the same diameter as that of first portion 25.

Fourth and fifth members 38 and 39 are designed to support third member 37, are made of high-transmittance material, e.g. antireflection-processed optical glass, and are designed to prevent movement of the light beam in a direction perpendicular to optical axis B.

Sixth member 40 is substantially rectangular, is superimposed on third, fourth and fifth members 37, 38 and 39 to prevent movement of third member 37 in a direction parallel to optical axis B, and is made of high-transmittance material, e.g. antireflection-processed optical glass.

Fourth, fifth and sixth members 38, 39 and 40 are supported by border 41, and in particular by plates 43*a* and 43*b*, which are shaped to house and secure fourth member 38, fifth member 39 and sixth member 40 in such a manner as to support third member 37.

In other words, filter 21 is defined by three layers : a first layer comprising first member 35 and second member 36; a second layer comprising third member 37, fourth member 38 and fifth member 39; and a third layer comprising sixth member 40.

As in the FIG. 3 embodiment, frame 22 also supports reflector 4, the outer edge 17 of which is fitted to frame 22 by coupling means 33.

The lighting fixture according to the present invention advantageously comprises a heat-shield filter 21 to prevent overheating of the light source.

Heat-shield filter 21 is designed to filter invisible hot light (which heats the body on which it impinges) and so prevent it from striking the dichroic filters; and to filter the visible hot light reflected by the dichroic filters.

Dichroic filters 20, in fact, reflect visible hot light, which is responsible for critical heating of the light source.

More specifically, most heating occurs in lateral portion 13*b*, close to heat-shield assembly 8, housing the electric contacts powering electrodes 14.

Heat-shield filter 21 according to the present invention comprises a portion 25 for mainly filtering the light reflected by the dichroic filters and responsible for overheating light source 3. Light source 3 is thus protected against overheating, to achieve a longer working life adequate to the requirements of the lighting fixture.

Above all, the visible-light filtering portion 25 does not affect the quality of the beam from lighting fixture 1, by being located in a shadow area of light source 3 and producing no loss in the useful light projected by the beam.

Clearly, changes may be made to the lighting fixture as described herein without, however, departing from the scope of the accompanying Claims.

The invention claimed is:

1. A stage lighting fixture comprising:

a casing extending along a longitudinal axis the casing a closed end and an open end opposite to the closed end along the longitudinal axis;

a light source arranged inside the casing for emitting a light beam along an optical axis;

a reflector coupled to the light source;

at least one dichroic filter for selectively intercepting the light beam; and at least one heat-shield assembly located between the light source and the dichroic filter; the heat-shield assembly comprising a heat-shield filter having a first portion with first beam filtering properties, and a second portion with second beam filtering properties differing from the first beam filtering properties; and the first portion and the second portion being substantially planarly contiguous, wherein the heat-shield assembly further comprises a plate for supporting the heat-shield filter.

2. A lighting fixture as claimed in claim 1, wherein the first portion is located at the centre of the heat-shield filter, and the second portion surrounds the first portion.

3. A lighting fixture as claimed in claim 1, wherein the first portion is circular and located at the centre of the heat-shield filter; and the second portion is annular and surrounds the first portion.

4. A lighting fixture as claimed in claim 3, wherein the light source comprises a bulb which has a centre portion housing two electrodes, and two substantially tubular lateral portions; the first portion being sized on the basis of the size of the lateral portion next to the heat-shield assembly.

5. A. lighting fixture as claimed in claim 1, wherein the heat-shield filter is defined by a number of coupled members.

6. A lighting fixture as claimed in claim 5, wherein the heat-shield filter is defined by a first member and a second member, each of which comprises half of the first portion and half of the second portion.

7. A lighting fixture as claimed in claim 5, wherein the heat-shield filter is defined by a first member and second member coupled to define the second portion; a third member defining the first portion; and a fourth member, fifth member, and sixth member for supporting the third member.

8. A lighting fixture as claimed in claim 1, wherein the second portion is designed to filter hot light in the invisible range, and the first portion is designed to filter hot light in the visible range.

9. A lighting fixture as claimed in claim 1, wherein the first portion has a transmittance of roughly 0.1 to 0.5% for wavelengths of roughly 400 to 650 nm.

10. A lighting fixture as claimed in claim 1, wherein the first portion has a transmittance of over 20% for wavelengths of roughly 650 to 1000 nm.

11. A lighting fixture as claimed in claim 1, wherein the second portion has a transmittance of over 90% for wavelengths of roughly 425 to 680 nm.

12. A lighting fixture as claimed in claim 1, wherein the second portion has a transmittance of least than 3% for wavelengths of roughly 800 to 1150 nm.

13. A stage lighting fixture comprising a light source for emitting a light beam along an optical axis;

a reflector coupled to the light source;

at least one dichroic filter for selectively intercepting the light beam;

at least one heat-shield assembly located between the light source and the dichroic filter;

the heat-shield assembly comprising a heat-shield filter having a first portion with first beam filtering properties, with a second portion with second beam filtering properties differing from the first beam filtering properties; and the first portion and the second portion being substantially planarly contiguous; and a frame having a central hole to let the light beam through, and designed to support the heat-shield filter over the central hole.

14. A stage lighting fixture comprising a casing extending, along a longitudinal axis, the casing having a closed end and an open end opposite to the closed end along the longitudinal axis;

a light source arranged inside the casing for emitting a light beam along an optical axis;

a reflector coupled to the light source;

at least one dichroic filter for selectively intercepting the light beam; and least one heat-shield assembly located between the light source and the dichroic filter, the heat-shield assembly comprising a heat-shield filter having a first portion with first beam filtering properties, and a second portion with second beam filtering properties differing from the first beam filtering properties, wherein the first portion and the second portion are substantially planarly contiguous and the second portion is designed to filter hot light in an invisible range, and the first portion is designed to filter hot light in a visible range; wherein the heat-shield assembly comprises a frame for supporting the heat-shield filter.

15. A stage lighting fixture comprising:

a casing extending along a longitudinal axis, the casing having a closed end and an open end opposite to the closed end along axis;

a light source for emitting as light beam along an optical axis: the light source being housed inside the casing;

a reflector coupled to the light source;

at least one dichroic filter for selectively intercepting the light beam;

at least one heat-shield assembly located between the light source and the dichroic filter; the heat-shield assembly comprising a heat-shield filter having a first portion with first beam filtering properties, and a second portion with second beam filtering properties differing from the first beam filtering properties; and the first portion and the second portion being substantially planarly contiguous; and a plate which is fitted to the casing, has a central hole to let the light beam through, and is designed to support the heat-shield filter over the central hole.

* * * * *